United States Patent [19]

Pearson

[11] 4,270,971

[45] Jun. 2, 1981

[54] APPLICATOR FOR A DOUBLE COATED TAPE STRIP

[75] Inventor: Walter C. Pearson, St. Paul, Minn.

[73] Assignee: Minnesota Mining and Manufacturing Company, St. Paul, Minn.

[21] Appl. No.: 85,726

[22] Filed: Oct. 17, 1979

[51] Int. Cl.[3] ..... B32B 31/04

[52] U.S. Cl. ..... 156/510; 156/517; 156/530; 156/579

[58] Field of Search ..... 156/518, 521, 530, 538, 156/577, 579, 510, 520, 517

[56] References Cited

U.S. PATENT DOCUMENTS

| | | | |
|---|---|---|---|
| 3,455,769 | 7/1969 | Way | 156/530 |
| 3,624,235 | 11/1971 | Kleid | 156/530 |
| 3,676,266 | 7/1972 | Jensen et al. | 156/521 |
| 3,930,927 | 1/1976 | Thompson | 156/530 |

FOREIGN PATENT DOCUMENTS

| | | | |
|---|---|---|---|
| 1132532 | 3/1957 | France | 156/530 |

*Primary Examiner*—Michael G. Wityshyn
*Attorney, Agent, or Firm*—Cruzan Alexander; Donald M. Sell; John C. Barnes

[57] ABSTRACT

A dispenser and applicator for double coated pressure sensitive adhesive tape comprising a feed wheel for advancing tape from the roll, cutting a definite length of tape, stripping the length of tape from the roll and applying it to a receptor with the stripping and applicating fingers being then releasable from the tape.

1 Claim, 6 Drawing Figures

APPLICATOR FOR A DOUBLE COATED TAPE STRIP

FIELD OF THE INVENTION

This invention relates to a dispenser for double-coated pressure-sensitive adhesive tape which will automatically apply a predetermined measured length of tape to a receptor surface. The machine functions totally mechanically to cut a length of tape on a feed roller, apply the severed length of tape to the desired surface, and advance a further length of tape to the applying position as the machine comes to rest.

DESCRIPTION OF THE PRIOR ART

The present invention comes in a field replete with earlier known dispensing devices which have dispensed pressure-sensitive adhesive tape but few of the dispensers have properly or adequately been able to dispense mechanically predetermined measured lengths of double-coated pressure-sensitive adhesive tape. Prior art dispensers have utilized a rotatable member with axially extending pins affording rotation thereof to advance tape. An example is U.S. Pat. No 3,930,927, issued Jan. 6, 1976 to D. N. Thompson. In this dispenser the tape was advanced on the feed wheel 18 as the feed wheel was moved toward the applicating position. When it reached the applying position the tape was advanced and then it was cut by a knife 24 during application of the length of tape. It then was returned by a spring 32 to the next position. In U.S. Pat. No. 3,455,769, for tape coated on one surface, the tape is advanced about a square rotatable member, is cut to a predetermined length on an anvil and then the member is rotated and moved to the applying position. Rotation is afforded by axially extending pins and application is afforded by pressing the tape against the receptor and lifting the applicating and advancing member to separate the tape therefrom. Thus, in the prior art the application is direct from the feed wheel or member and the procedural steps are performed in different order. Further, the structure affording the various operations accomplished by the dispenser of the present invention are new and novel. The actuating movement and the return of the actuator accomplishes the desired steps of cutting the predetermined length of tape, applying the severed length of tape by stripping it from the feed roll and advancing a successive length of tape to applying position in one smooth orderly cycle of operation.

SUMMARY OF THE INVENTION

The dispenser of the present invention cuts a predetermined length of tape from a roll, separates the cut length from the feed roller and applies the tape to a receptor, and advances tape from the roll. The dispenser comprises a frame, first means on said frame for supporting a convolutely wound roll of double-coated pressure sensitive adhesive tape for rotation about an axis, and a feed roller mounted on an axis parallel to the axis of said first means for the roll of tape. The feed roller comprises a plurality of spaced circular disc-like members, and an axially spaced drive wheel for the incremental rotation of said feed roller.

A knife is pivotally mounted on the frame and movable toward and away from said feed roller for cutting a length of tape wrapped upon said feed roller. Second means bias the knife to a normal position away from said feed roller.

An applicator strips the cut length of tape from the feed roller and directs the tape against a receptor surface. The applicator comprises a plurality of spaced tape-applying fingers disposed one between each pair of disc-like members on the feed roller. The stripping and applicating fingers are mounted for movement about an axis parallel to the axis of the feed roller and are biased to a position with their tape engaging surface radially inward from the peripheral surface of the feed roller.

A handle, pivotally mounted on the frame for movement relative thereto, is connected to an actuator which is mounted for reciprocal movement and the actuator drives the knife against the bias of the second means to sever a length of tape on said feed roller, it then acuates said fingers to move them from between said disc-like members to a position lifting said tape from said feed roller and applying the tape to a receptor. Upon return, the actuator rotates the drive wheel to advance more tape from the supply roll.

BRIEF DESCRIPTION OF THE ACCOMPANYING DRAWINGS

The present invention will hereinafter be described in greater detail with reference to the accompanying drawing wherein.

DETAILED DESCRIPTION OF THE ACCOMPANYING DRAWING

Figure 1:
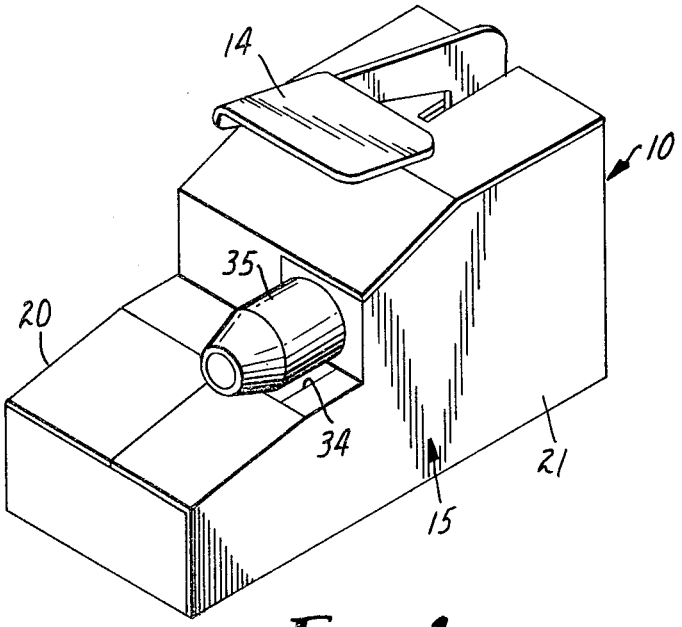
FIG. 1 is a perspective view of a dispenser incorporating the present invention.

A first form of the device is illustrated in the attached drawings and discloses a desk-type model of a dispensing device for applying predetermined length strips of double-coated pressure-sensitive adhesive tape to the receptor. The machine can be made in a hand operated model wherein the support for the receptor is not part of the dispenser.

The illustrated dispenser, generally designated 10, is adapted to be supported on a counter, table or other surface, and is provided with a frame which supports the dispensing mechanism for operation by a handle 14 pivotally supported on the frame and extending above an exterior housing 15 surrounding the tape dispensing mechanism and the supply of tape. The frame comprises a base plate 16 and a generally vertically extending wall member 17 positioned centrally of the base plate 16 and transversely spaced from a second stabilizing wall 19. The tape dispensing mechanism is mounted in a cantilever fashion from the central wall 17 and extends in a direction away from the wall 19.

A fixed housing 20 covers the operating mechanism for the dispensing apparatus and a movable cover 21, hinged by the pins 23 (FIG. 2) covers the supply of tape and the dispensing structure. The roll of tape 25 is supported on a mandrel 26 and extends therefrom about a feed roller 28. On the feed roller 28 the tape is first severed into a predetermined length by a cutting blade assembly 30 having a knife and the severed length of tape is then stripped from the feed roller and placed into contact with the receptor surface. The tape is stripped from the feed roller by an applicator comprising fingers 31 which apply the tape to the receptor. In the illustrated embodiment the receptor 33 is placed into a receiving area beneath a rotatable anvil member 35 which is positioned above an opening 34 in a planar surface of the housing cover member 21.

The feed roller 28 comprises a plurality of axially spaced discs of uniform diameter having circumferentially spaced notches or recessed areas 32. The discs also have a roughened or knurled outer periphery which contacts the adhesive on the tape. The discs are fixed to a shaft 36 journalled in the walls 17 and 19. The shaft 36 has a drive wheel 37 supported thereon between the walls 17 and 19. The wheel 37, as illustrated, has three axially extending pins 48 equally spaced about the drive wheel to afford a drive mechanism for the feed roller as will hereinafter be described.

Figure 2:
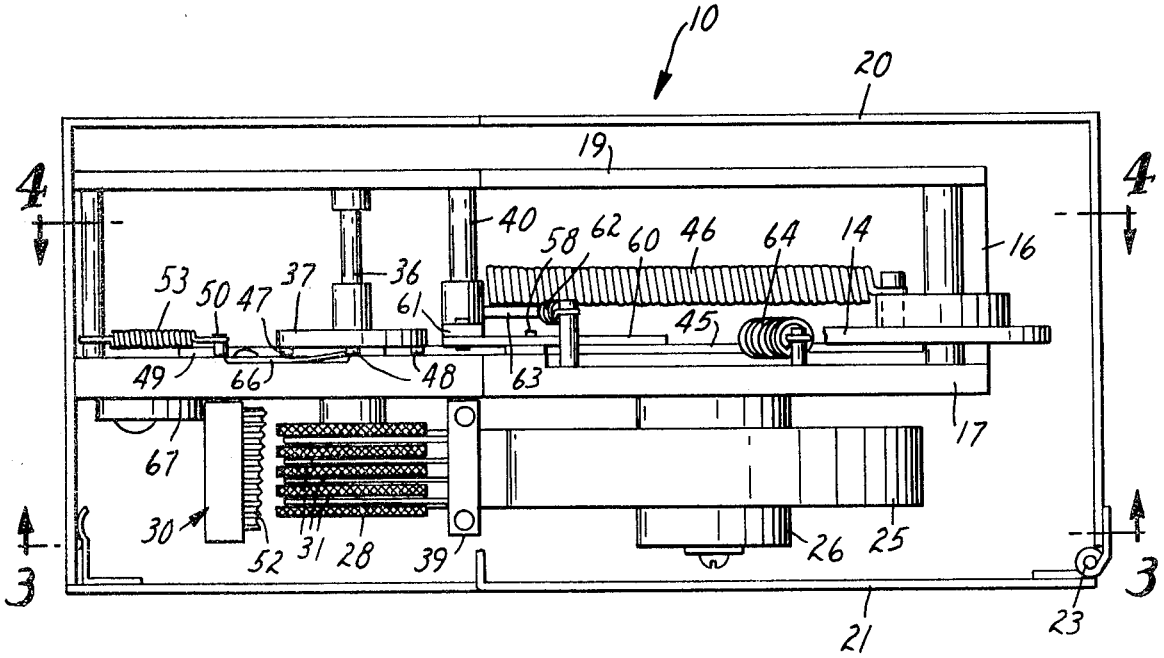
FIG. 2 is a horizontal sectional view of the dispenser of FIG. 1 with the section line taken through a general midportion of the dispenser.
Figure 3:
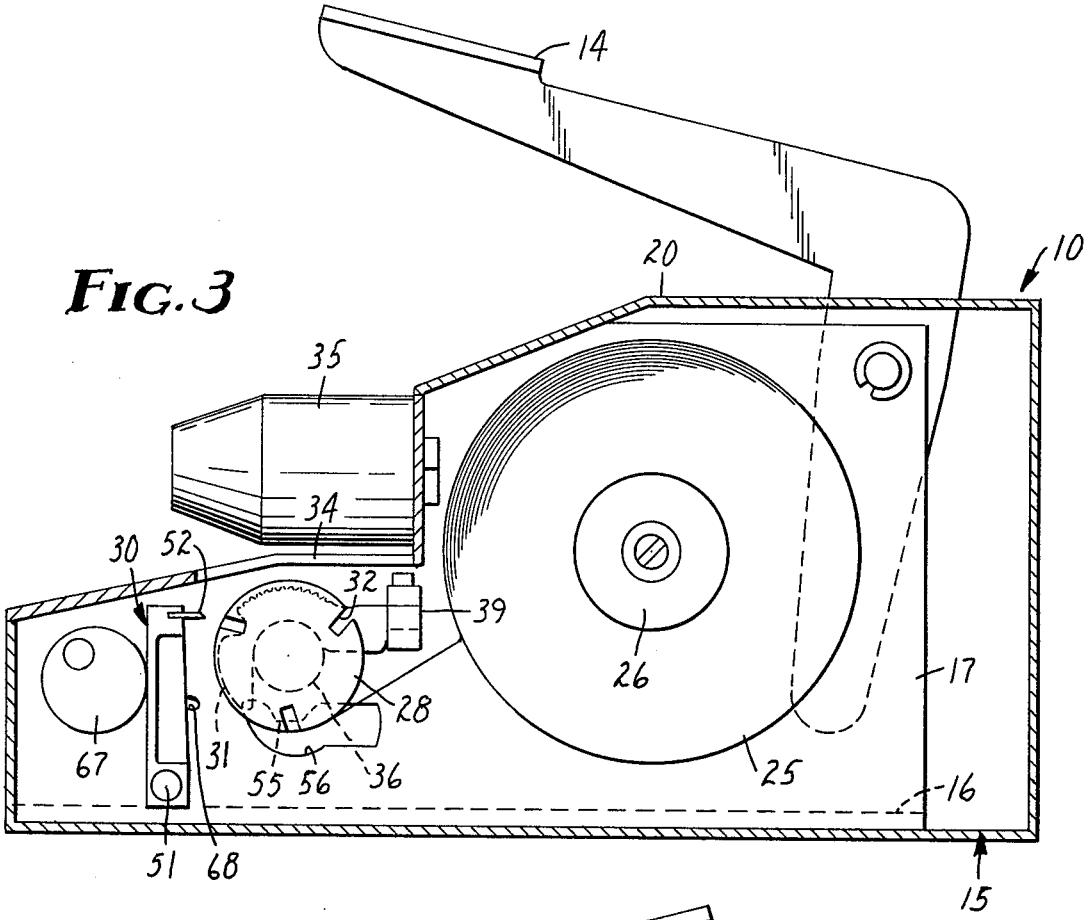
FIG. 3 is a longitudinal sectional view taken along the lines 3—3 of FIG. 2.
Figure 4:
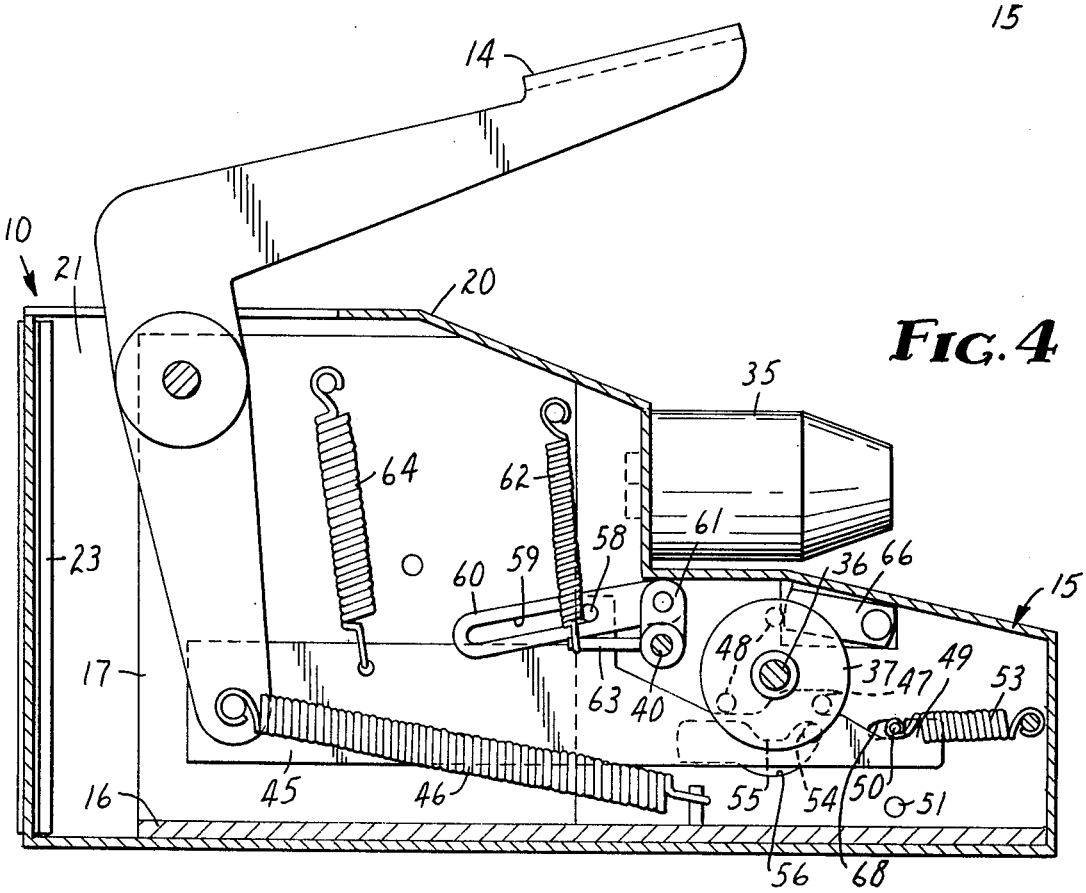
FIG. 4 is a longitudinal sectional view taken along the lines 4—4 of FIG. 2.
Figure 5:
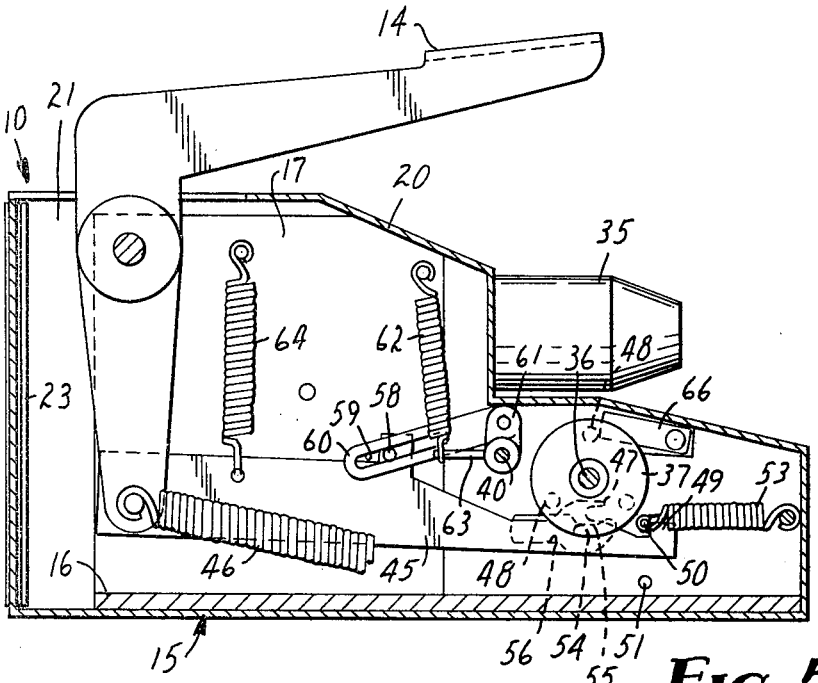
FIG. 5 is a longitudinal sectional view taken generally along the same lines as FIG. 4 with the parts in the position when the cutting operation is completed.
Figure 6:
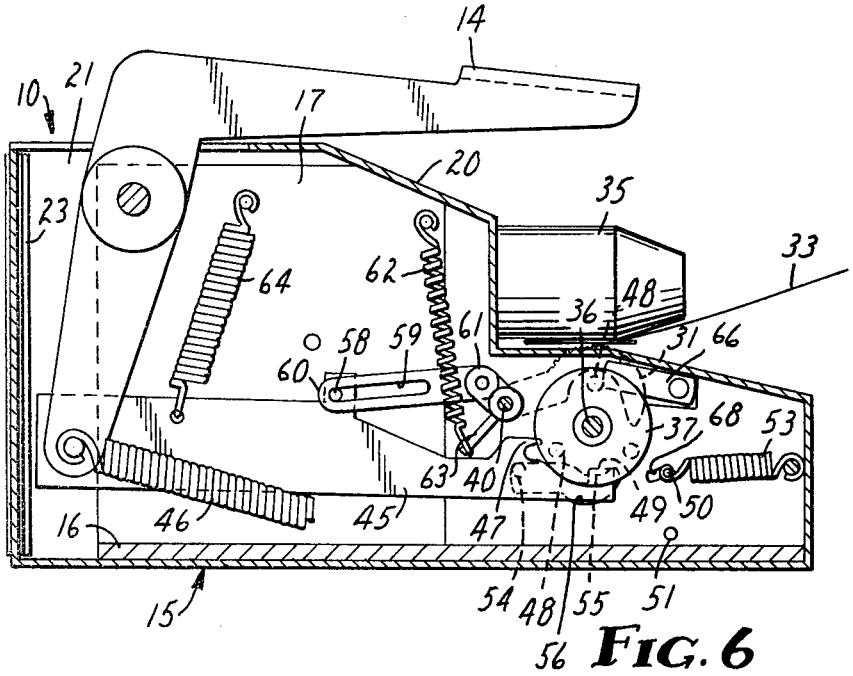
FIG. 6 is a longitudinal sectional view taken along the section line corresponding to that of FIG. 4 showing the dispenser in the tape applying posision.

The applicating fingers 31 serve to strip the tape from the peripheral surface of the discs forming the feed roller 28. The applicating fingers 31 comprise a plurality of hook-shaped members as illustrated in FIGS. 2, 3, and 6, each having one end secured in spaced relation to the other fingers on a bar 39. Bar 39 is connected to a shaft 40 which is journalled in the walls 17 and 19. The fingers extend from the bar 39 and the hook portion of the fingers extend about the shaft 36 and are of a size and shape such that they will fit between the radially inward of the surface of the discs and are clear of the cutting edge of the blade assembly when in their normal position as shown in FIG. 3. When applying the tape to the receptor 33 they are pivoted about the axis of the bar 39 upwardly through the opening 34 in the housing 15 and against the receptor as indicated in FIG. 6. The tape engaging edges of fingers 31 are saw toothed or knurled to reduce adhesion between the fingers and the tape.

The drive mechanism for advancing the tape from the roll 25 and for applying the precut length of tape to the receptor will hereinafter be described. The drive mechanism comprises a reciprocating actuator 45 which is positioned between the central wall 17 and the drive wheel 37. This reciprocating actuator 45 is urged toward one end of the machine by a spring 46 to a normal position at which it has advanced a length of tape about the periphery of the feed roller 28 by the engagement of a hook 47 with a pin 48 on the wheel 37. Operation of the dispenser by the movement of the handle 14 will cause reciprocation of the actuator 45. As the actuator is moved rearwardly by the movement of the handle 14 a projection 49 on the front end of the actuator engages a roller 50 extending through the wall 17 from the cutting blade assembly 30, causing the cutting knife to pivot about an axis 51, driving the cutting edge 52 into recessed areas 32 of the discs of the feed wheel 28 to sever the tape. As the actuator 45 continues to be retracted, a roller 54 engages a cam surface 55 formed by an opening 56 cut into the wall 17 such that the actuator is driven downwardly at its forward end, releasing the roller 50 and allowing the blade assembly 30 to be retracted under the force of the spring 53.

As the actuator 45 now further continues its rearward movement a pin 58 supported on a projection on the upper edge thereof and movable in a slot 59 engages the end of the slot to pull a drag link 60. The link 60 causes rotation of a crank arm 61 and the rotation of the shaft 40. As the shaft 40 is rotated the bar 39 turns about its axis, lifting the fingers 31 forcing the tape from engagement with the periphery of the discs of the feed wheel 28 upward through the opening and into engagement with the receptor backed by the anvil 35. The fingers are returned by a spring 62 connected to a radial pin 63 extending from the hub or sleeve supporting crank arm 61.

As the handle is now released, the actuator is drawn forward by the spring 46 and a spring 64 maintains the actuator raised such that the hook 47 will engage the next pin 48 causing a partial rotation of the feed roller 28 about its axis as the actuator returns to the home or rest position, withdrawing another length of tape from the roll 25.

A stop member 66 restricts the return of the feed roller 28 and thus each advance maintains a predetermined length of tape on the feed roller. A stop 67 restricts the movement of the blade assembly 30 or its movement can be restricted in both directions by the length of the slot 68 in wall 17 through which the shaft projects which supports the sleeve or roller 50.

Having thus described the present invention with reference to a preferred embodiment, it will be understood that various changes can be made in the structure of the parts illustrated without departing from the spirit or the scope of the invention described herein.

I claim:

1. A definite length tape applicator for applying cut lengths of double-coated tape comprising a frame, first means on said frame for supporting a convolutely wound roll of double-coated pressure-sensitive adhesive tape for rotation about an axis, a feed roller mounted on an axis parallel to the axis of said first means for the roll of tape and comprising a plurality of spaced circular disc-like members, and an axially spaced drive wheel for said feed roller, said feed roller having a plurality of circumferentially spaced notches extending generally radially of said peripheral surfaces of said disc-like members, a knife pivotally mounted on said frame and movable toward and away from said feed roller for cutting a tape wrapped upon said feed roller, second means biasing said knife to a position away from said feed roll, a plurality of spaced tape-applying fingers disposed one between each pair of said disc-like members for lifting the tape from the surface of said feed roller and applying the same to a receptor surface, said fingers being mounted for movement about an axis parallel to the axis of said feed roller and biased to a position with their tape engaging surface radially inward from the peripheral surface of the feed roller, a handle pivotally mounted on said frame for movement relative thereto, and third means connected to said handle and movable in response to relative movement of said handle with respect to said frame for moving said knife against the bias of said second means to sever a length of tape on said feed roller drawn from said supply of tape, for advancing said fingers from between said disc-like members to a position lifting said tape from said feed roller; and for rotating said feed roll upon return of said handle to said original position.

* * * * *